US007121688B2

(12) United States Patent
Rempel

(10) Patent No.: US 7,121,688 B2
(45) Date of Patent: Oct. 17, 2006

(54) BOX LIGHT

(76) Inventor: Lee W. Rempel, 1305 Sycamore Road, Kelowna, British Columbia (CA) V1X 7P4

( * ) Notice: Subject to any disclaimer, the term of this patent is extended or adjusted under 35 U.S.C. 154(b) by 74 days.

(21) Appl. No.: 11/067,678

(22) Filed: Mar. 1, 2005

(65) Prior Publication Data

US 2005/0190551 A1 Sep. 1, 2005

Related U.S. Application Data

(60) Provisional application No. 60/548,421, filed on Mar. 1, 2004.

(51) Int. Cl.
*F21V 21/14* (2006.01)

(52) U.S. Cl. ..... 362/250; 362/184; 362/185; 362/190; 362/249; 362/376; 362/427

(58) Field of Classification Search ..... 362/162, 362/184, 185, 190, 249, 250, 376, 377, 378, 362/427; 40/464, 571
See application file for complete search history.

(56) References Cited

U.S. PATENT DOCUMENTS 1,370,842 A 3/1921 Reeves
4,658,337 A 4/1987 Burke
4,707,766 A 11/1987 Bertozzi
5,890,793 A 4/1999 Stephens
6,164,801 A 12/2000 Alexander-Katz
6,659,620 B1 12/2003 Goto

*Primary Examiner*—Stephen F Husar
*Assistant Examiner*—Meghan K. Dunwiddie
(74) *Attorney, Agent, or Firm*—Antony C. Edwards

(57) ABSTRACT

A box light includes a housing having first and second clamshell-halves. Each clamshell-half has a lamp face and an opposite exterior surface. At least one lamp and its corresponding protective enclosure is mounted in each of the lamp faces. Each of the lamp faces has at least one lamp-receiving aperture. The clamshell-halves are rotatably mounted to one another by a first hinge for rotation relative to another about the first hinge between open and closed positions. The open position includes selectively position-able open positions exposing the lamp faces so that an included angle between the lamp faces may be opened to two hundred seventy degrees whereby the lamps on each lamp face shines outwardly and oppositely of the housing when electrically powered. In the closed position the lamp faces are in closely adjacent opposed facing relation and the exterior surfaces are oppositely disposed. Also, when in the closed position, the at least one lamp and its protective enclosure on each of the first and second clamshell-halves is aligned and mated with the lamp-receiving aperture on the opposed facing lamp faces so as to insert at least the protective enclosure of each of the at least one lamps into mating engagement with the corresponding lamp-receiving apertures in the opposed facing lamp faces.

20 Claims, 15 Drawing Sheets

BOX LIGHT

CROSS REFERENCE TO RELATED APPLICATIONS

This application claims priority from U.S. Provisional Patent Application No. 60/548,421 filed Mar. 1, 2004 entitled Box Light.

FIELD OF THE INVENTION

This invention relates to portable lighting systems that are rugged and adaptable to general work lighting applications primarily in construction, temporary service and maintenance.

BACKGROUND OF THE INVENTION

Adequate work lighting in construction, service, or maintenance applications is necessary for a safe effective working environment. The conventional so-called "trouble light", that is, an incandescent bulb protected by and mounted within a cage, has been a mainstay of temporary indoor work lighting for years. More recently stand-supported quartz halogen work lamps, and variations of stand-supported fluorescent work lamps have become common.

It is known that when using many of these temporary portable light sources that they often cannot be maintained in adequate position, and/or are vulnerable to damage during transportation, which adversely affects their portability. Previously attempts have been made to resolve this problem by enclosing a portable light within a case. Examples are as follows:

U.S. Pat. No. 6,659,620 which issued to Goto on Dec. 9, 2003, describes a portable lighting apparatus that contains lighting and stage for photographing objects placed on the case stage.

U.S. Pat. No. 6,164,801 which issued to Alexander-Katz on Dec. 26, 2000, describes a self contained portable lighting system having first and second closures with florescent tube lamps and fold out reflectors. The two closures can be co-joined to form an array of such lighting systems, and when not in use fastened to each other to form a unitized case protecting the lighting elements within.

U.S. Pat. No. 5,890,793 which issued to Stephens on Apr. 6, 1999, describes a portable luminescent lighting system with a split case, plurality of elongated lamps, and reflector shields placed there between, providing directed lighting for television, video and film production.

U.S. Pat. No. 4,707,766 which issued to Bertozzi et al. on Nov. 17, 1987, describes a modular lighting projector for illuminating from the ground in theatres, studios and the like.

U.S. Pat. No. 4,658,337 which issued to Burke on Apr. $14^{th}$, 1987, describes a portable fluorescent lighting device with a pivotally joined collapsible frame that serves as both as a stand and protective enclosure.

U.S. Pat. No. 1,370,842 which issued to Reeves on Mar. $8^{th}$, 1921, describes a photographer's portable light having a rectangular case containing incandescent lamps offset from each other in each half of the case. The two halves of the case open one hundred eighty degrees about a common hinge so as to expose the lamps.

SUMMARY OF THE INVENTION

The present invention is a clamshell opening light box which, in its open position serves to illuminate a work area, and which, in its closed position is portable and durable for transport. The light box contains a longitudinally spaced array of lamps mounted along the length of each half of a clamshell housing. The halves of the clamshell are hinged together at a common hinge so as to form a hinged rectangular enclosure when in the closed position. Lamps protrude from at least one of the clamshell-halves when the enclosure is in the open position. The protruding lamps are shrouded within matching recesses in the opposite clamshell-half when the enclosure is closed. Each lamp is protected by an enclosure-mounted cage to prevent breaking the lamp when accidentally struck. Each cage also mates into the corresponding recess in the opposite clamshell-half The enclosure may include a handle for transport, collapsible legs for upright support, and cable mounts for suspended support. The enclosure includes a switch to turn the lamps on and off, and may include a cutoff switch that prevents the inadvertent powering of the lamps and subsequent overheating of the enclosure when the two halves of the enclosure are closed. In addition, a utility power receptacle may be integrated into a side-wall of the enclosure for the additional powering of hand tools and other accessories.

In summary, the box light according to the present invention may be characterized in one aspect as including a housing having first and second clamshell-halves. Each clamshell-half has a lamp face and an opposite exterior surface. At least one lamp and its corresponding protective enclosure is mounted in each of the lamp faces. Each of the lamp faces has at least one lamp-receiving aperture. The clamshell-halves are rotatably mounted to one another by a first hinge for rotation relative to another about the first hinge between open and closed positions. The open position includes selectively positionable open positions exposing the lamp faces so that an included angle between the lamp faces may be increased to substantially two hundred seventy degrees whereby the clamshell-halves are folded back on each other and consequently the at least one lamps shine outwardly and oppositely of the housing when the lamps are electrically powered. In the closed position the lamp faces are in closely adjacent opposed facing relation and the exterior surfaces are oppositely disposed. Also, when in the closed position, the at least one lamp and its protective enclosure on each of the first and second clamshell-halves are aligned and mated with the corresponding lamp-receiving aperture on the opposed facing lamp faces so as to insert at least the protective enclosure of each of the at least one lamps into mating engagement with the corresponding lamp-receiving apertures in the opposed facing lamp faces.

In one preferred embodiment, the at least one lamp on the first clamshell-half and the at least one lamp on the second clamshell-half are offset relative to one another, and the at least one aperture in the lamp face on the first clamshell-half is offset relative to the at least one aperture in the lamp face on the second clamshell-half The lamps and apertures are arranged so that a first lamp of the at least one lamp on the lamp face of the first clamshell-half mates into a first aperture of the at least one aperture of the lamp face of the second clamshell-half, and a first lamp of the at least one lamp on the lamp face of the second clamshell-half mates into a first aperture of the at least one aperture of the lamp face of the first clamshell-half.

Advantageously, each of the lamp faces on the clamshell-halves have a plurality of lamps mounted therein and have a corresponding number of apertures therein, wherein the plurality of lamps and apertures on the first clamshell-half are diametrically offset relative to the plurality of lamps and apertures on the second clamshell-half.

In one embodiment the first hinge further includes means for selectively angularly positioning the clamshell-halves relative to one another about the first hinge. For example, the means for angularly positioning may include a selectively actuable latch or other means for selectively locking the included angle at least at substantially 135 degrees, one hundred eighty degrees or two hundred seventy degrees. To facilitate pivoting the clamshell-halves more than one hundred eighty degrees about the first hinge so as to fold the clamshell-halves into a two hundred seventy degree, or more, back-to-back open position, advantageously the ends of the housing adjacent the first hinge are sloped or inclined faces, for example, sloped or inclined so as to form an angle of forty five degrees between the sloped or inclined faces and the corresponding lamp face of the corresponding clamshell-half. Thus, with the clamshell-halves in the two hundred seventy degree open position, with the inclined faces inclined at substantially forty five degrees, the inclined faces are abutting or closely adjacent so that the inclined faces limit the pivoting of the clamshell-halves about the first hinge.

In a preferred embodiment, at least one leg may be pivotally mounted to the exterior surface of the first clamshell-half adjacent the hinge, so that the leg may be pivoted between a stored position flush against the first clamshell-half, and a deployed position wherein a distal end of the leg is extended from the exterior surface so as to support the first clamshell-half with the first hinge and the second clamshell-half elevated. The at least one leg may include a pair of legs. The pair of legs may be mounted to a second hinge for pivoting between the stored and deployed positions. Each leg of the pair of legs may be itself rotatably mounted to the second hinge for spreading apart of the pair of legs to form a tripod, quadra-pod etc. as the case may be, which includes each leg and the first clamshell-half or each leg and the first and second clamshell-halves.

A proximity sensor may advantageously be provided for sensing when the first and second clamshell-halves are substantially in the closed position and, in response, for shutting off electrical power to the lamps whereby the lamps will not be left on when the housing is closed.

In one embodiment the exterior surface of the first clamshell-half includes at least a pair of ridges so that, in the stored position, the pair of legs are recessed flush against the ridges. The ridges may be parallel and disposed along opposite longitudinal edges of the exterior surface of the first clamshell-half. An electrical cord may be mounted, at one end of the cord, in electrical co-operation with the plurality of lamps, the cord extending from the first clamshell-half. Means for storing the cord may be provided, that is, mounted on the exterior surface of the first clamshell-half. For example, the means for storing the cord may include resilient clips mounted on the first clamshell-half.

In a further embodiment at least one flexible line may be mounted to the housing for suspending from a rigid structure the clamshell-halves when in their open position. The at least one flexible line may include a pair of flexible lines 40 mounted one at each opposite end of the housing when in the open position. The protective enclosures may each include a cage protruding from the corresponding lamp faces. A box latch may be provided for selectively latching closed the first and second clamshell-halves when in their closed position.

DETAILED DESCRIPTION OF EMBODIMENTS OF THE INVENTION

Figure 6:
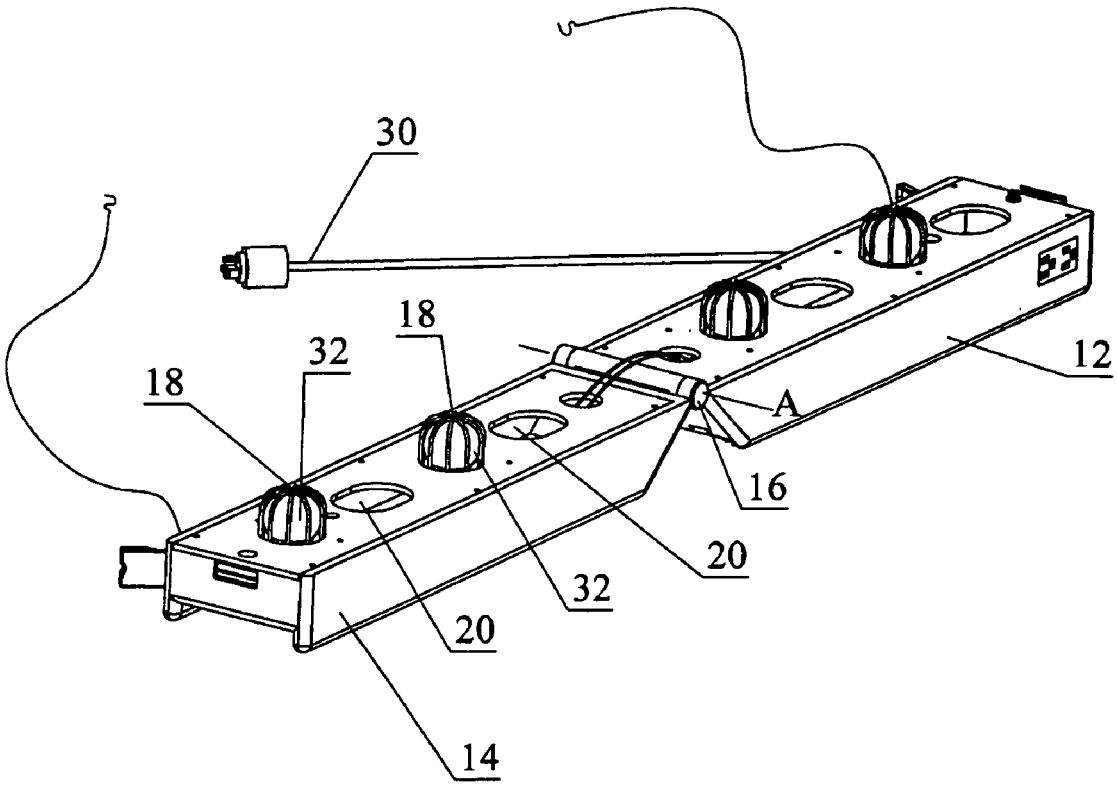
FIG. 6 is, in front top perspective view, the light box of FIG. 5 in its one hundred eighty open position.

With reference to the drawings, wherein similar characters of reference denote corresponding parts in each view, the present invention may be characterized as a self-contained, clamshell-opening, portable box light 10. Box light 10 has two clamshell-halves 12 and 14 mounted to one another about a common first hinge 16 so that the two halves open and close about the hinge. When the two halves are in the closed position of FIG. 1, the planar lamp faces 12*a* and 14*a* of the halves are closed together in opposed facing relation so as to nest, or at least align, the lights on one clamshell-half with corresponding apertures on the opposed facing clamshell-half. Because the light cages 18 protrude from the planar lamp faces 12*a* and 14*a* of the corresponding halves 12 and 14, and because cages 18 mate into corresponding apertures 20 in the opposed facing opposite clamshell-half, the volume of the box light housing may be minimized for ease of transportation and storage. Apertures 20 also provide for cooling of the light bulbs 22 mounted behind cages 18 when it is desired to close the light box following use without having to wait for the light bulbs to cool down before closing the clamshell-halves. Further, in the incandescent bulb embodiment of the box light as seen commencing in FIG. 6, the bulb itself protrudes from the corresponding planar lamp face so that once again the volume of the box light is minimized by having both the bulb and its corresponding cage 18 mate with the corresponding aperture 20 or recess in the opposed facing opposite clamshell-half when the box light is in the closed position.

Hinge 16 allows rotation of the clamshell-halves about an axis of rotation A which lies substantially in the interface plane containing the interface between the clamshell-halves when in the closed position. Each clamshell-half is tapered at one end corresponding to the end mounted to hinge 16, for example, by the use of planar inclined angled faces 12*b* and 14*b* respectively on the hinge ends of clamshell-halves 12 and 14. Faces 12*b* and 14*b* are inclined at angle β relative to the interface plane between clamshell-halves 12 and 14 when in the closed position. In the illustrated embodiment, not intended to be limiting, angle β is substantially forty five degrees.

Figure 2:
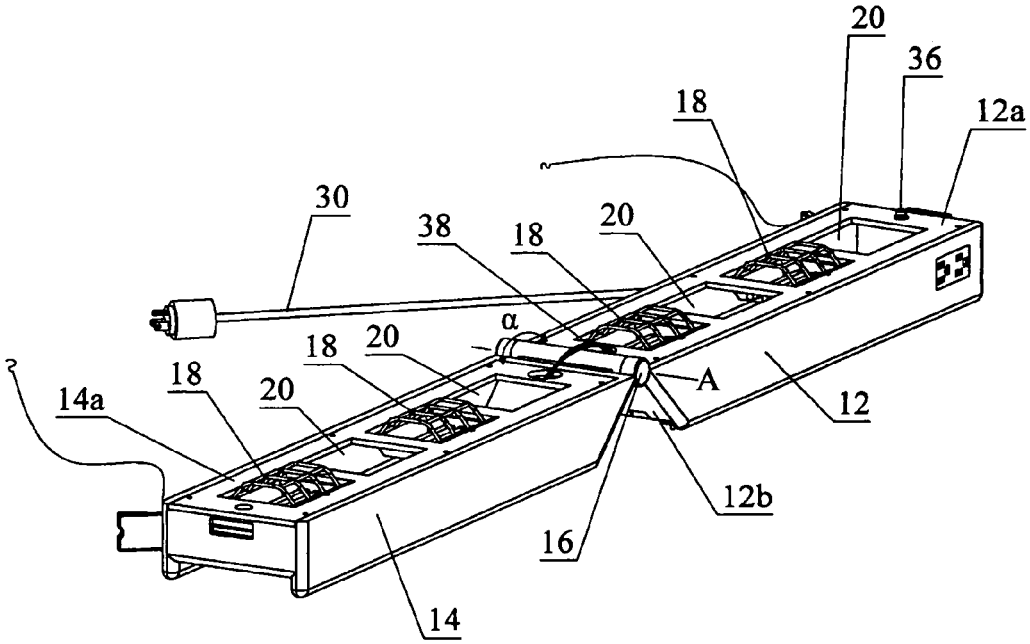
FIG. 2 is, in front top perspective view, the light box of FIG. 1 in its 180 degree open position.
Figure 2A:
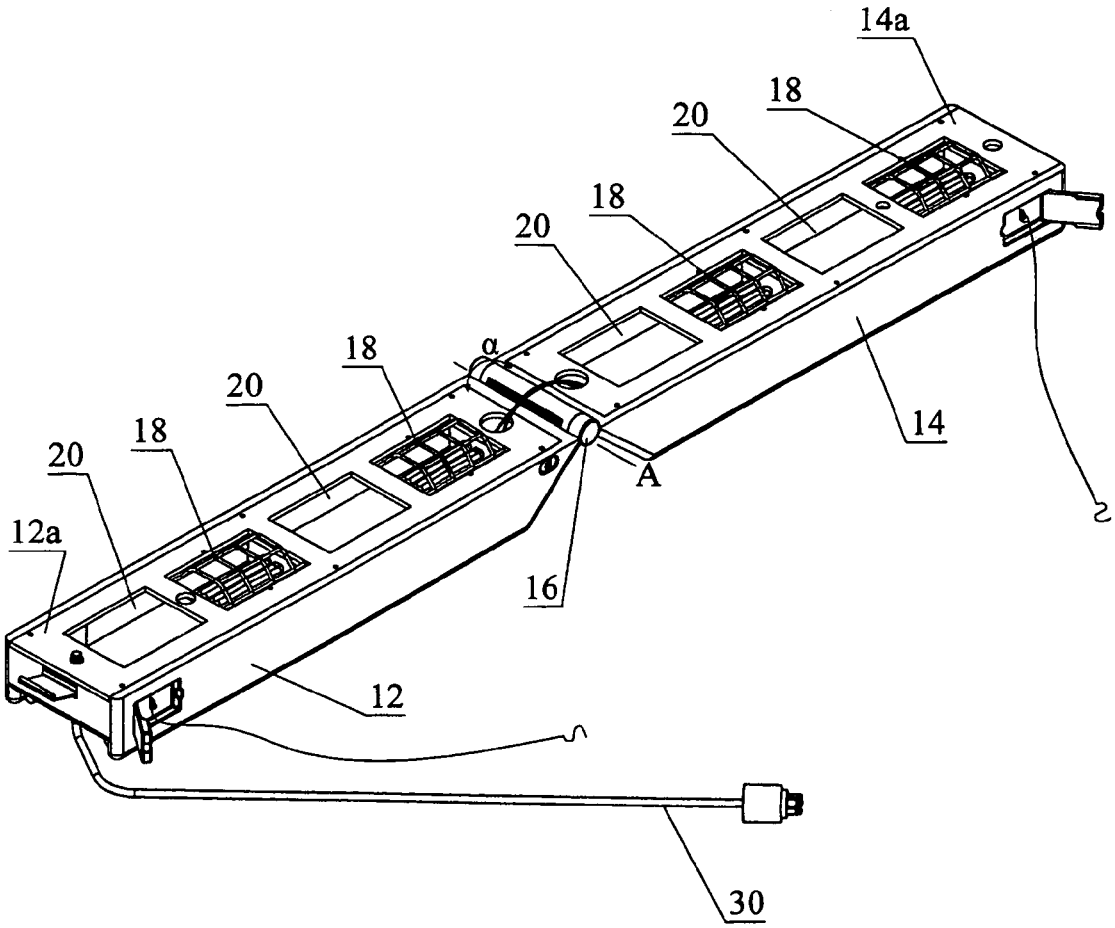
FIG. 2*a* is, in rear top perspective view, the light box of FIG. 1 in its 180 degree open position.
Figure 3:
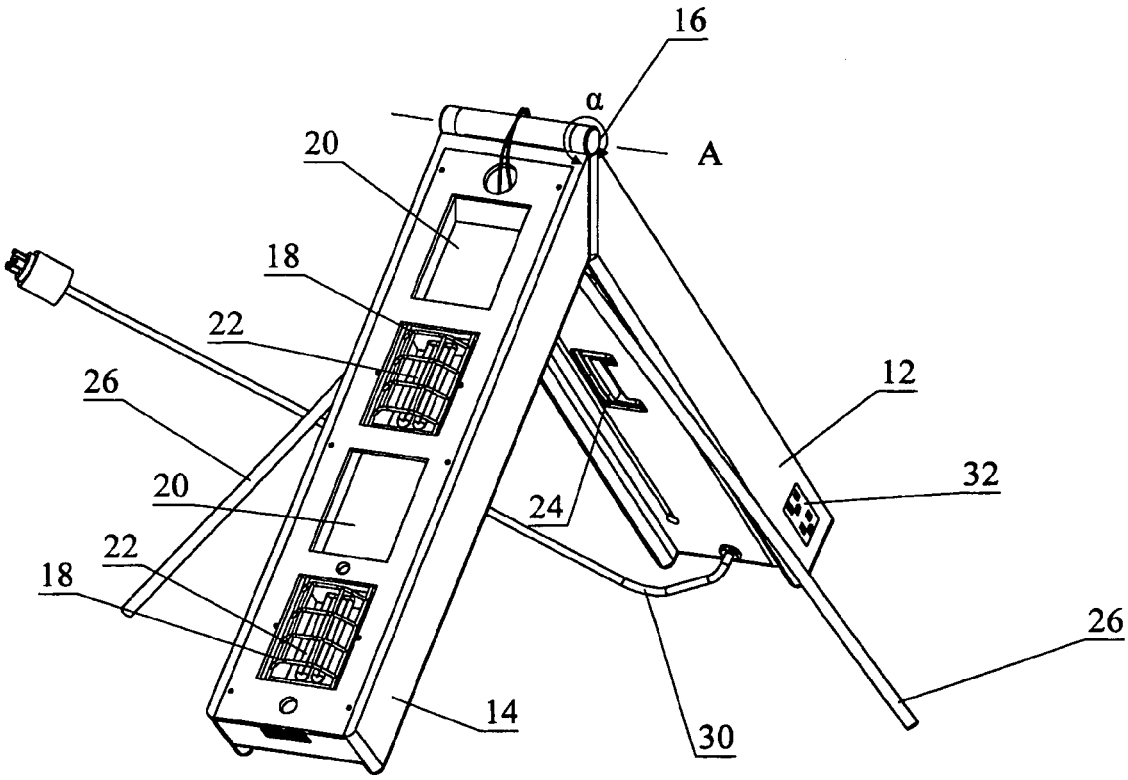
FIG. 3 is, in front top perspective view, the light box of FIG. 1 in its 270 degree open position.
Figures 3, 3A:
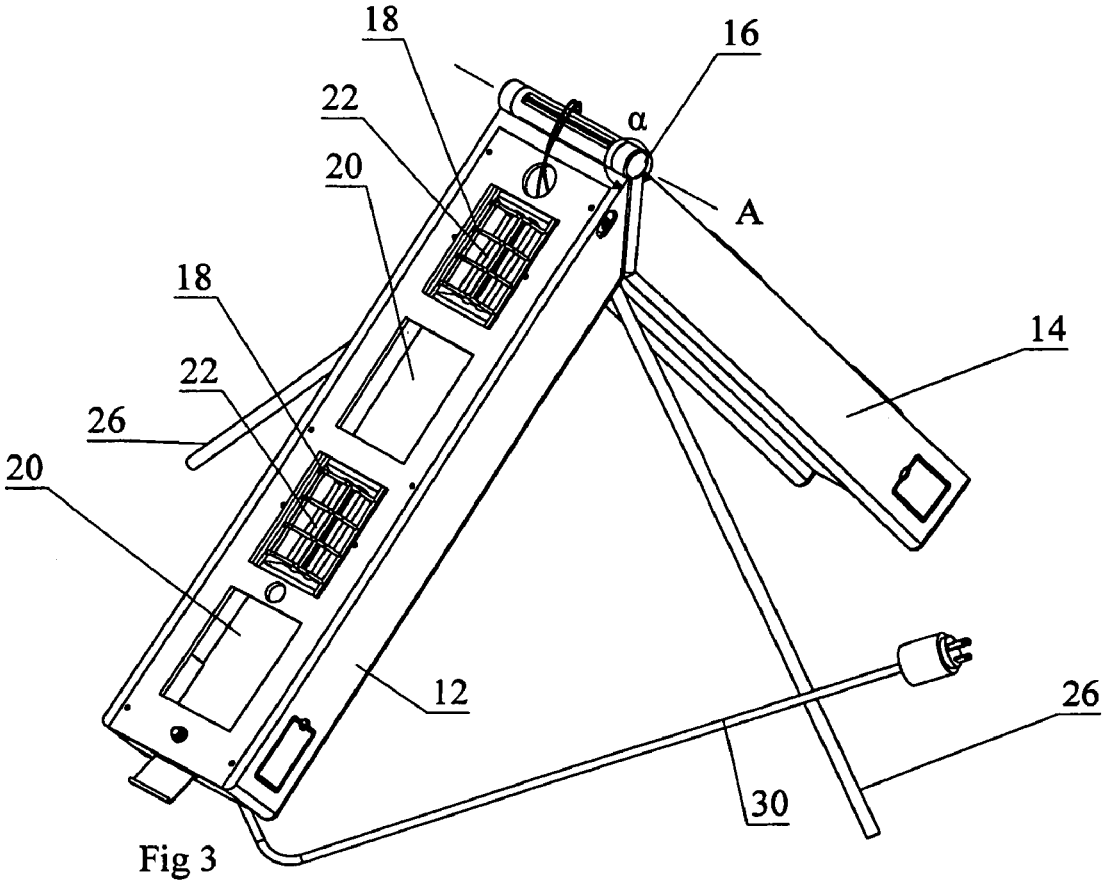
FIG. 3*a* is, in rear top perspective view, the light box of FIG. 1 in its 270 degree open position.
Figure 3B:
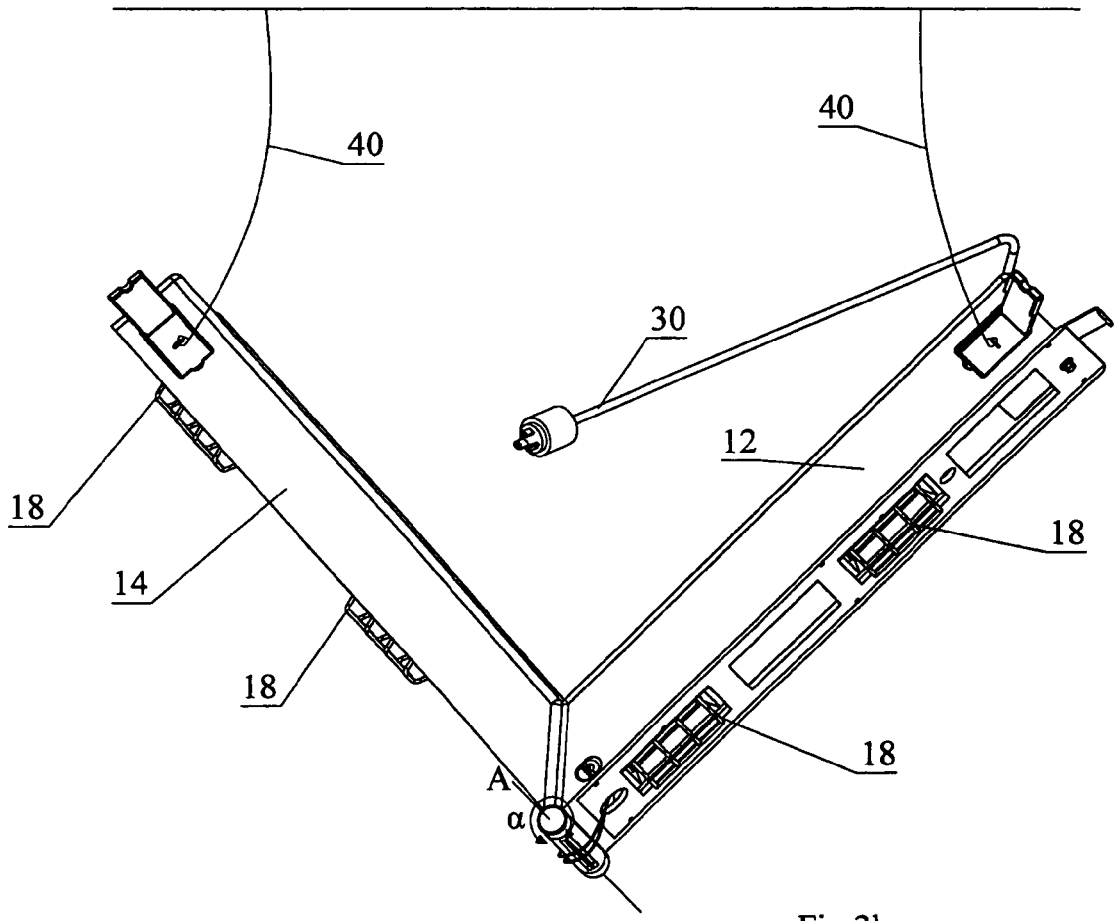
FIG. 3*b* is, in perspective view, the light box of FIG. 3*a* suspended from a rigid support by a pair of flexible lines.
Figure 4:
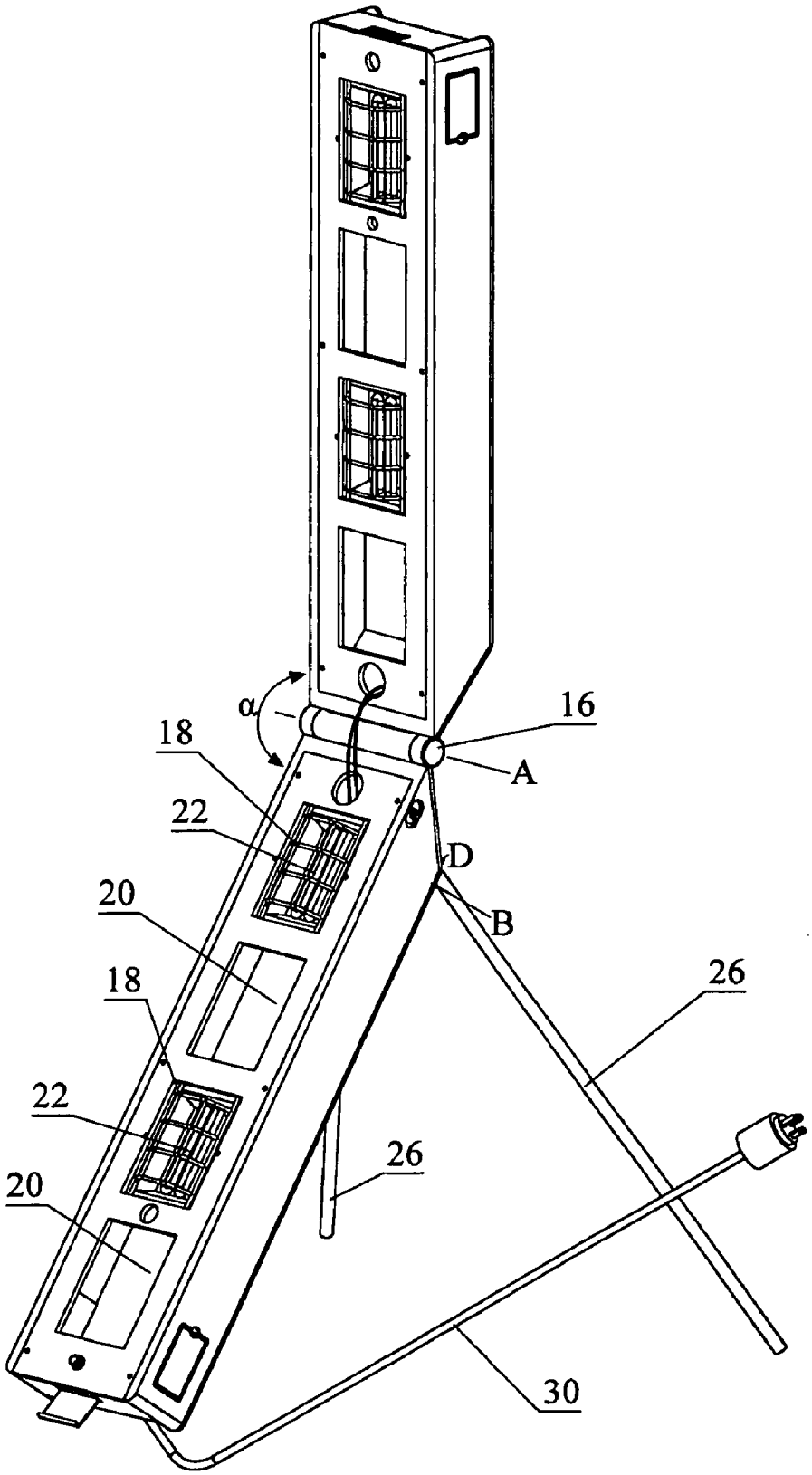
FIG. 4 is, in front top perspective view, the light box of FIG. 1 in an approximately 135 degree open position.

The tapered ends and in particular angled faces 12*b* and 14*b* provide a stop that limits the rotation of the clamshell-halves about hinge 16 when the box light is in its most fully opened position. In the illustrated embodiment, the ends are tapered at substantially forty five degrees such that angle α is approximately two hundred seventy degrees when faces 12*b* and 14*b* are abutted or closely adjacent as seen in FIG. 3. However, the box light is also useful at other angles, for example an angle α of one hundred eighty degrees such as seen in FIG. 2, or when angle α is approximately one hundred thirty five degrees or thereabouts such as seen in FIG. 4.

Figure 1:
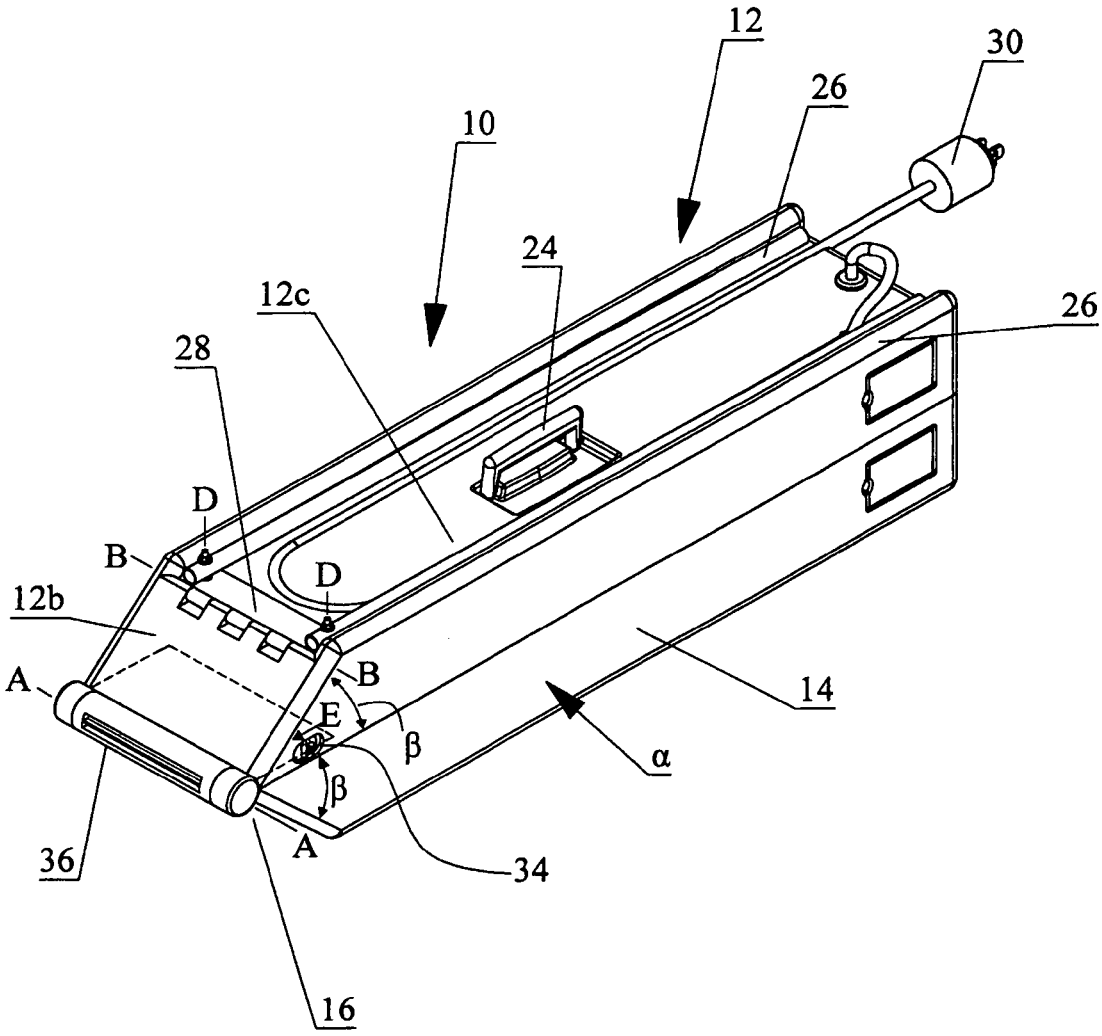
FIG. 1 is, in front top perspective view, one embodiment of the light box and present invention in its closed position.
Figure 1A:
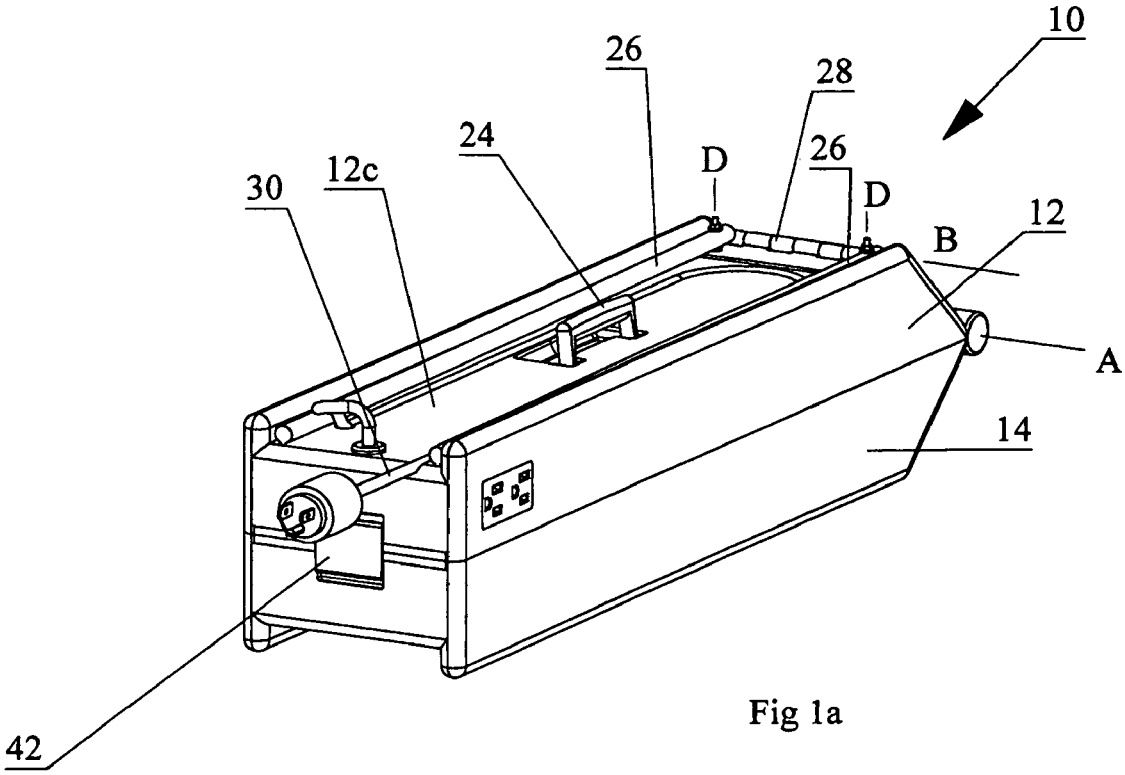
FIG. 1*a* is, in rear top perspective view, one embodiment of the light box and present invention in its closed position.
Figure 4A:
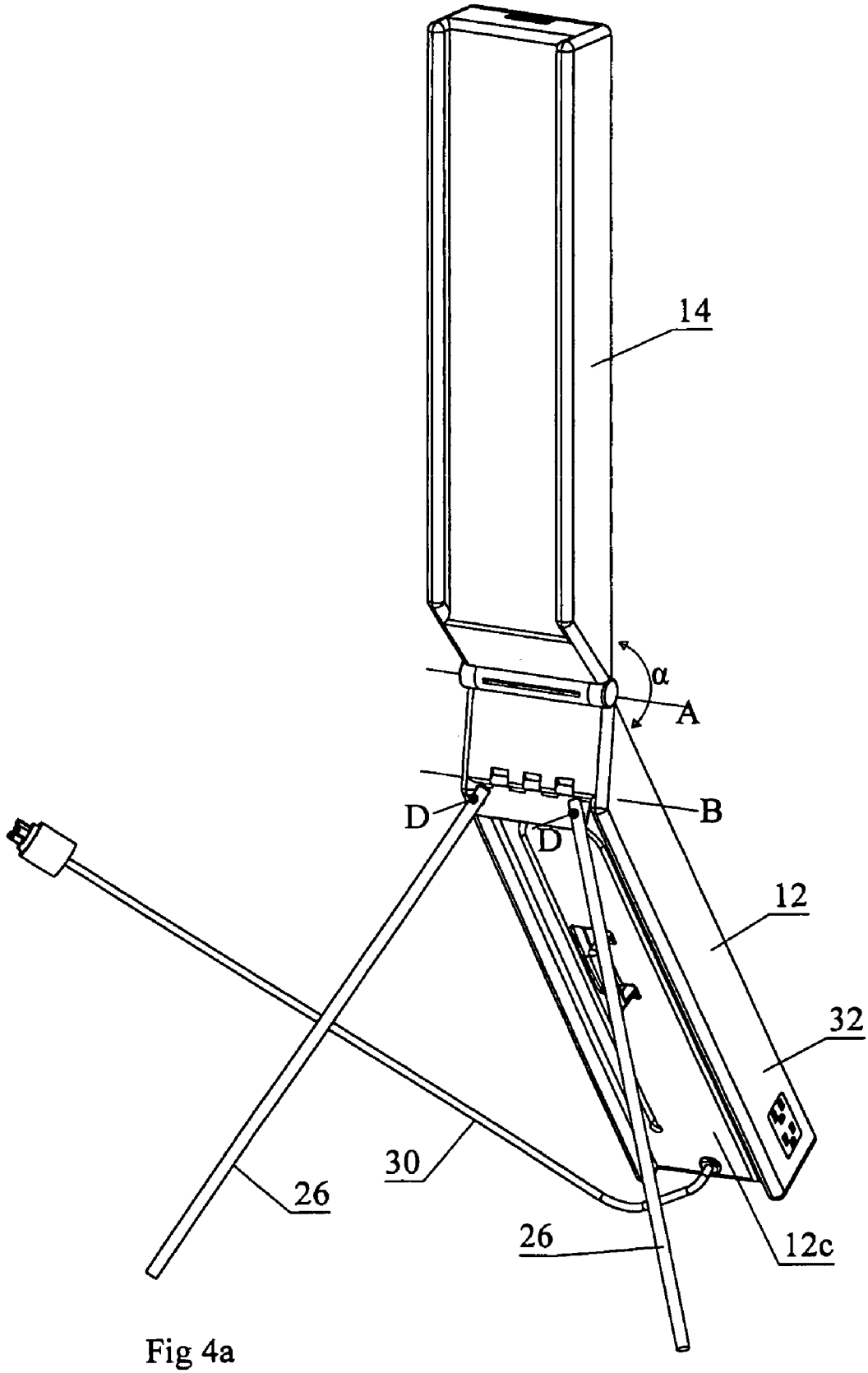
FIG. 4*a* is, in rear top perspective view, the light box of FIG. 1 in an approximately 135 degree open position.
Figure 5:
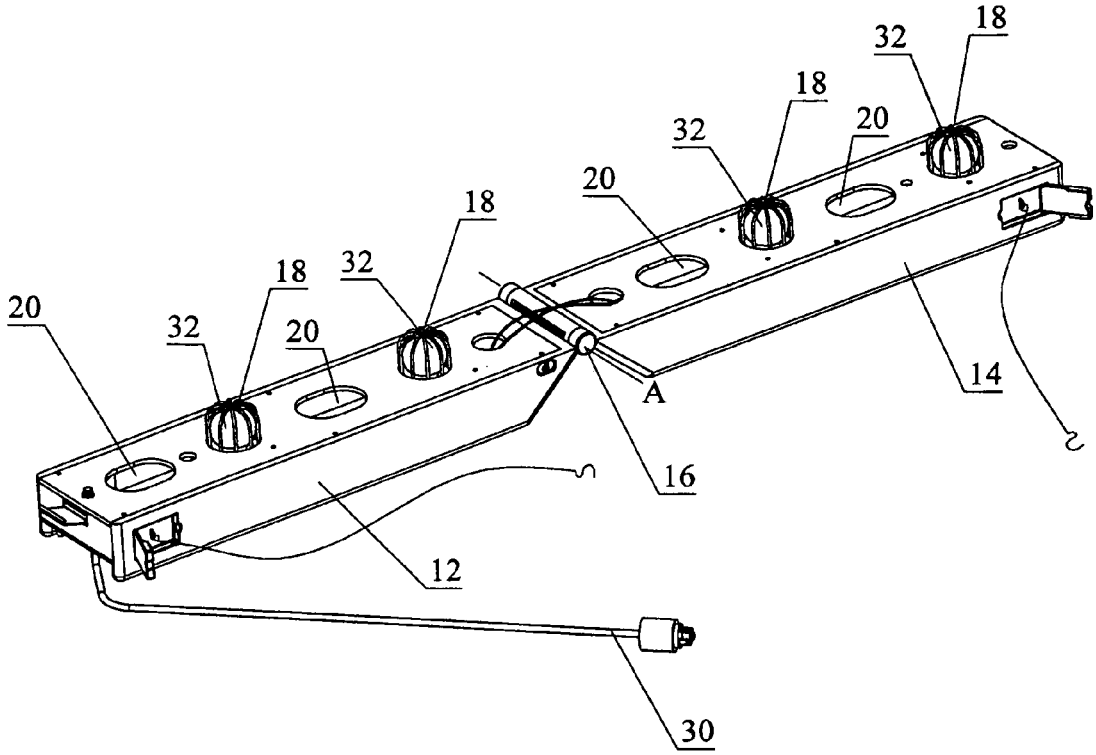
FIG. 5 is, in rear top perspective view, an alternative embodiment of the light box according to the present invention in its one hundred eighty degree open position.
Figure 7:
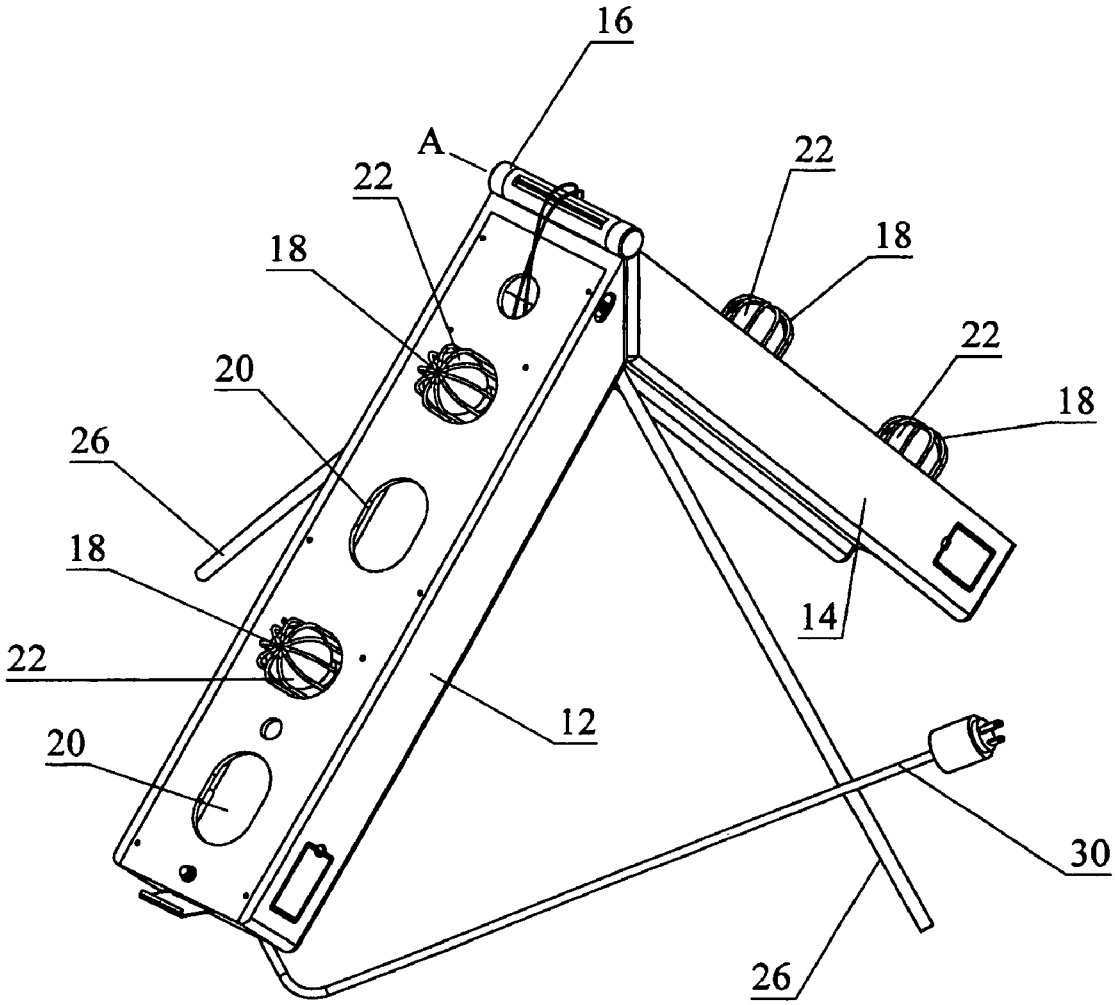
FIG. 7 is, in rear top perspective view, the light box of FIG. 5 in its two hundred seventy degree open position.
Figure 7A:
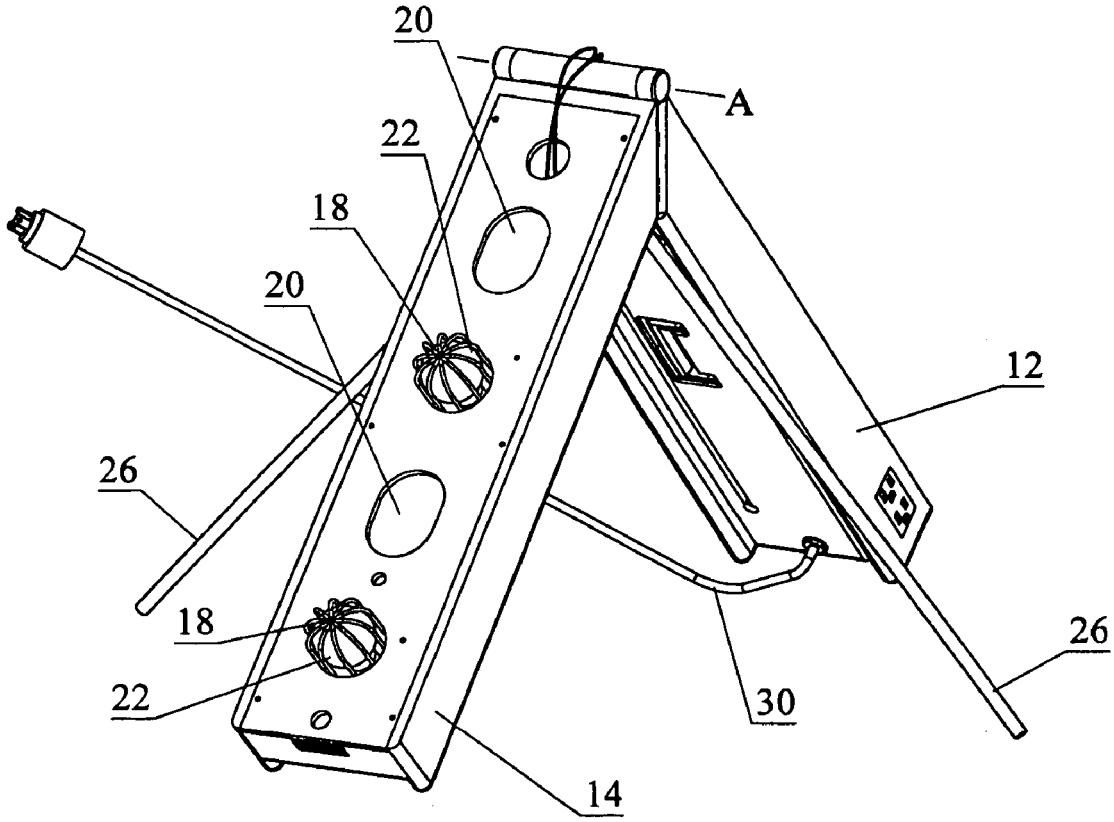
FIG. 7*a* is, in front top perspective view, the light box of FIG. 5 in its two hundred seventy degree open position.
Figure 7B:
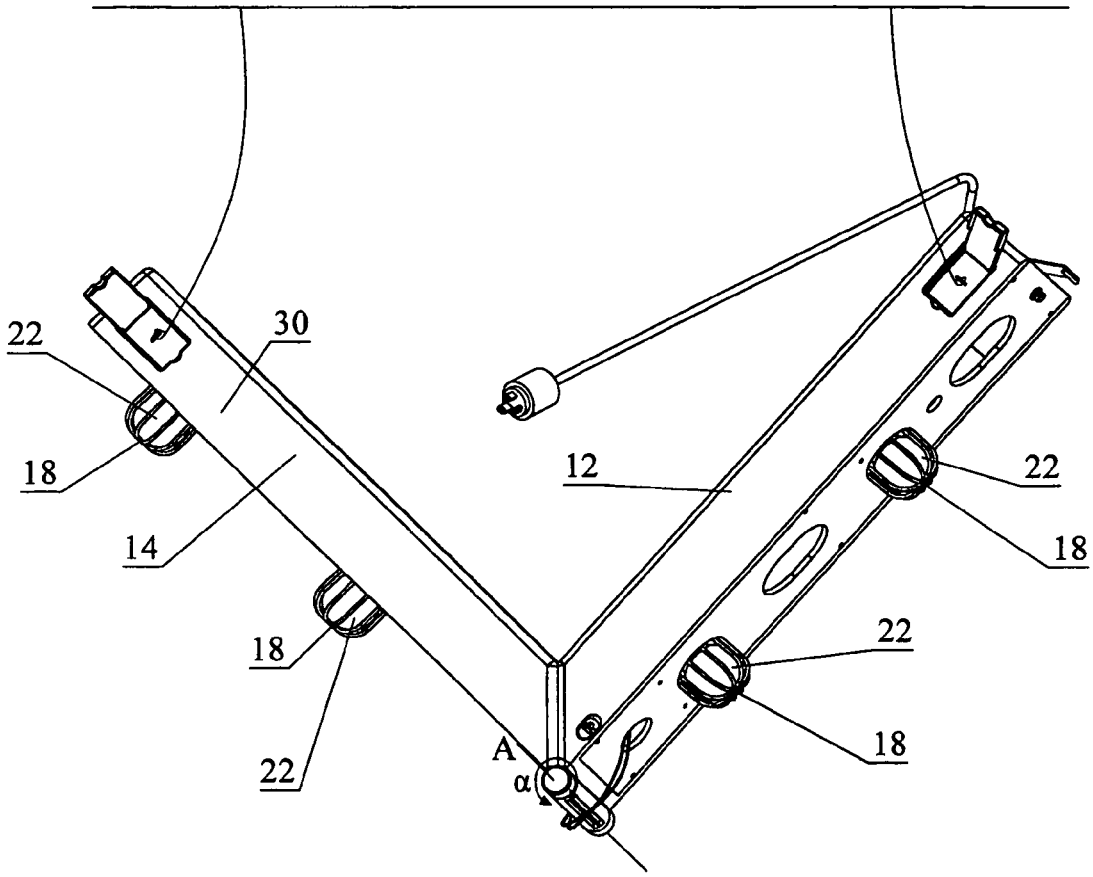
FIG. 7*b* is, in perspective view, the light box of FIG. 7 inverted and suspended from a rigid support structure by a pair of flexible lines.
Figure 8:
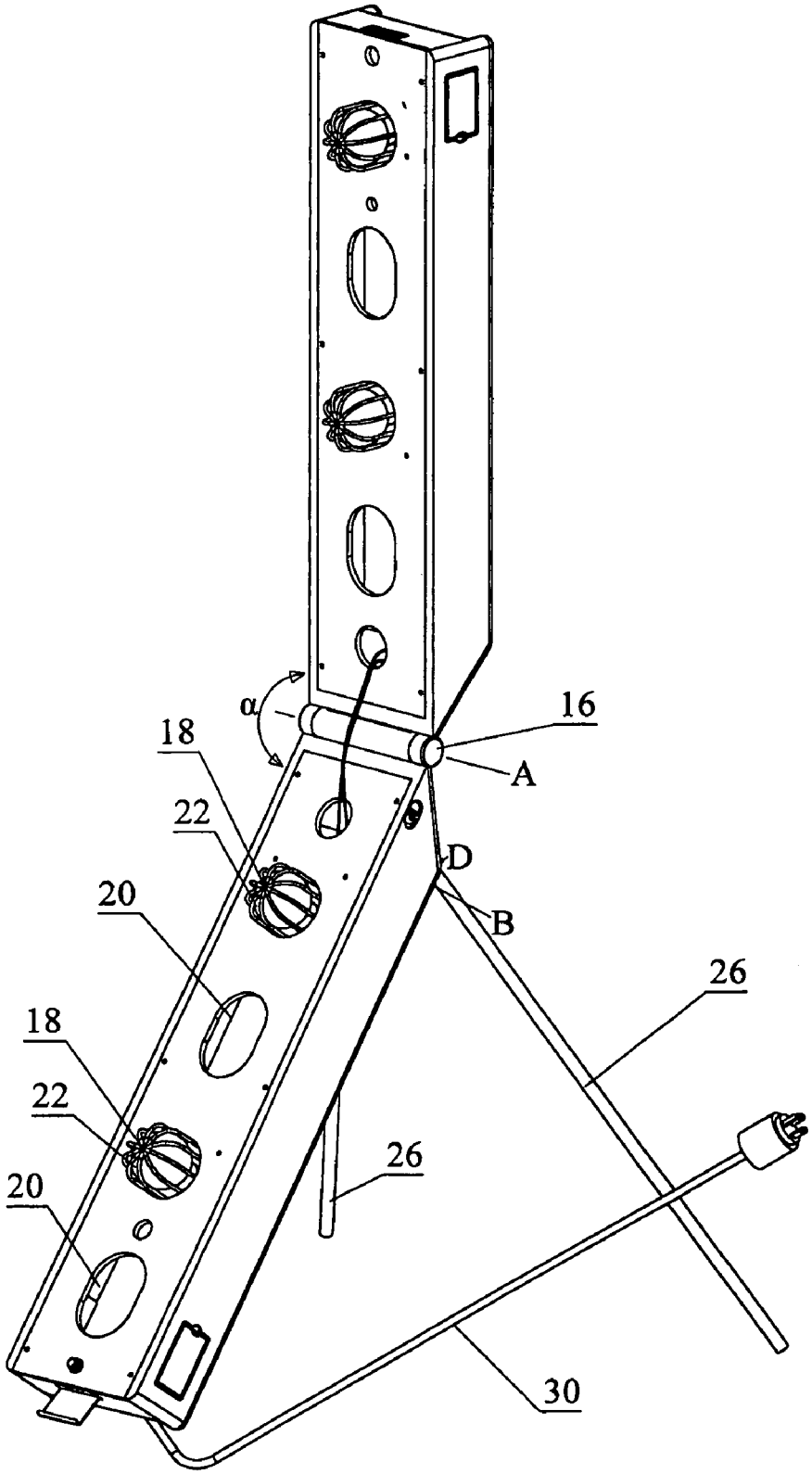
FIG. 8 is, in front top perspective view, the light box of FIG. 5 in an approximately one hundred thirty five degree open position.

Clamshell-half 12 may serve as the upper half of the box light when closed using box latch 42 for storage and transportation. Thus, a folding handle 24 is mounted in the outer surface 12*c* of clamshell-half 12, preferably at the balance point of the box light. Further, a pair of extendable rigid legs 26 may be secured to outer surface 12*c* when in their folded down position as seen in FIG. 1. Legs 26 are in the illustrated embodiment, which is not intended to be limiting, pivotally mounted by means of hinge 28 for rotation about axis of rotation B. Each of the legs 26 are themselves pivotally mounted to hinge 28 for rotation about axes of rotation D so that the legs may be spread apart to form a tri-pod between the two legs and clamshell-half 12 to elevate the lights into a useful position as best seen in FIGS. 4, 4*a* and 8, or to form a quadra-pod between the two legs and the two clamshell-halves when the clamshell-halves are in their two hundred seventy degree or most fully open position such as seen in FIGS. 3 and 7.

Electrical cord 30 may also be mounted to clamshell-half 12, for example, so as to exit from clamshell-half 12 through an aperture in outer surface 12*c*, in which case, clips or the like mounted on outer surface 12*c* may be used to store electrical cord 30 for transportation and storage. An electrical plug receptacle 32 may be mounted to clamshell-half 12, although this is not intended to limiting, so that other power tools may be plugged in to the light box as a source of electrical power.

Hinge 16 may also be provided with a latch mechanism so that the latch may be engaged to releasably lock clamshell-half 14 in a desired angular orientation relative to clamshell-half 12. Thus for example, which is not intended to be limiting, a latch slide 34 (shown in dotted outline in FIG. 1) mounted within clamshell-half 12 adjacent hinge 16 and operated by thumb slide 34*a* in direction E slides into an aligned slot 36 of an array of slots spaced apart around hinge 16.

In one preferred embodiment, within each clamshell-half are two lamps 22 which may be halogen, incandescent, fluorescent, light-emitting diode, etc each protected by a cage 18. The lamps and cages line up with holes or recesses 20 in the opposite clamshell-half when the two halves are closed. This provides protection for the lamp assemblies during transport. The holes also provide for ventilation of the lamps thereby limiting the likelihood of overheating.

A cut-off proximity switch 36 interrupts the supply current when the two halves of the box light are closed. An electrical switch controls electrical supply to the lamps. An electrical cable 38 conveys electricity from one clamshell-half to the other across the hinge joint of hinge 16.

The box light when opened to one hundred eighty or for example two hundred seventy degrees may be suspended by cables or chains (collectively referred to herein as flexible lines 40) mounted to the clamshell-halves from a ceiling, beam, pipe or like overhead structure.

The box light may be constructed of a variety of materials such as metal, wood, or plastic, using a variety of methods. Plastic may be vacuum formed, injection molded or rotationally molded. The preferred embodiment has all external components recessed to prevent snags and allow for convenient storage and stacking.

Alternative embodiments may include a retractable power cord, retractable or pocketed suspension cables within the enclosures.

As will be apparent to those skilled in the art in the light of the foregoing disclosure, many alterations and modifications are possible in the practice of this invention without departing from the spirit or scope thereof Accordingly, the scope of the invention is to be construed in accordance with the substance defined by the following claims.

What is claimed is:

1. A box light comprising a housing having first and second clamshell-halves each having a lamp face and an opposite exterior surface, at least one lamp and its protective enclosure mounted in each of said lamp faces, and said each of said lamp faces having at least one lamp-receiving aperture, said clamshell-halves rotatably mounted to one another by a first hinge for rotation relative to another about said first hinge between a closed position wherein said lamp faces are in closely adjacent opposed facing relation and said exterior surfaces are oppositely disposed, and selectively positionable open positions exposing said lamp faces so that an included angle between said lamp faces is selectively positionable up to where said clamshell-halves are folded back on one another about said first hinge so that said lamp faces are oppositely disposed whereby said at least one lamp on said lamp faces shine outwardly and oppositely of said housing when electrically powered, and wherein in said closed position said at least one lamp and its protective enclosure on each of said first and second clamshell-halves is aligned and mated with said lamp-receiving aperture on said opposed facing lamp faces so as to insert at least said protective enclosure of each of said at least one lamps into mating engagement with corresponding said lamp-receiving apertures in said opposed facing lamp faces.

2. The box light of claim 1 wherein said at least one lamp on said first clamshell-half and said at least one lamp on said second clamshell-half are offset relative to one another, and wherein said at least one aperture in said lamp face on said first clamshell-half is offset relative to said at least one aperture in said lamp face on said second clamshell-half so that a first lamp of said at least one lamp on said lamp face of said first clamshell-half mates into a first aperture of said at least one aperture of said lamp face of said second clamshell-half, and a first lamp of said at least one lamp on said lamp face of said second clamshell-half mates into a first aperture of said at least one aperture of said lamp face of said first clamshell-half.

3. The box light of claim 2 wherein each of said lamp faces on said clamshell-halves have a plurality of lamps mounted therein and have a corresponding number of apertures therein, wherein said plurality of lamps and apertures on said first clamshell-half are diametrically offset relative to said plurality of lamps and apertures on said second clamshell-half.

4. The box light of claim 3 wherein said first hinge further comprises means for selectively angularly positioning said clamshell-halves relative to one another about said first hinge.

5. The box light of claim 4 wherein said means for angularly positioning includes means for selectively locking said included angle at least at substantially 135 degrees, substantially one hundred eighty degrees or substantially two hundred seventy degrees.

6. The box light of claim 5 wherein said means for angularly positioning includes a selectively actuable latch.

7. The box light of claim 1 further comprising at least one leg pivotally mounted to said exterior surface of said first clamshell-half adjacent said hinge, said leg pivotable between a stored position flush against said first clamshell-half, and a deployed position wherein a distal end of said leg is extended from said exterior surface so as to support said first clamshell-half with said first hinge and said second clamshell-half elevated.

8. The box light of claim 7 wherein said at least one leg includes a pair of legs.

9. The box light of claim 8 wherein said pair of legs are mounted to a second hinge for pivoting between said stored and deployed positions, and wherein each leg of said pair of legs are rotatably mounted to said second hinge for spreading apart of said pair of legs to form a tripod including each said leg and said first clamshell-half and so as to form a quadra-pod including each said leg and said first and second clamshell-halves when in a fully open position of said open positions.

10. The box light of claim 3 further including a proximity sensor for sensing when said first and second clamshell-halves are substantially in said closed position and in response shutting off electrical power to said lamps whereby said lamps will not be left on when said housing is closed.

11. The box light of claim 8 wherein said exterior surface of said first clamshell-half includes at least a pair of ridges so that, in said stored position, said pair of legs are recessed flush against said ridges.

12. The box light of claim 11 wherein said ridges are parallel and disposed along opposite longitudinal edges of said exterior surface of said first clamshell-half.

13. The box light of claim 3 further comprising an electrical cord mounted, at one end of said cord, in electrical co-operation with said plurality of lamps, said cord extending from said first clamshell-half, means for storing said cord mounted on said exterior surface of said first clamshell-half.

14. The box light of claim 13 wherein said means for storing said cord includes resilient clips mounted on said first clamshell-half.

15. The box light of claim 1 further comprising at least one flexible line mounted to said housing for suspending from a rigid structure said clamshell-halves when in said open position.

16. The box light of claim 15 wherein said at least one flexible line includes a pair of flexible lines 40 mounted one at each opposite end of said housing when in said open position.

17. The box light of claim 1 wherein said protective enclosures each include a cage protruding from corresponding said lamp faces.

18. The box light of claim 1 further comprising a box latch for selectively latching closed said first and second clamshell-halves when in said closed position.

19. The box light of claim 1 wherein ends of said clamshell-halves adjacent said first hinge are formed as inclined faces so as to provide stops to prevent rotation of said clamshell-halves about said first hinge beyond a fully open position of said open positions.

20. The box light of claim 19 wherein said included angle is substantially two hundred seventy degrees when in said fully open position.

* * * * *